US006715566B2

(12) United States Patent
Wallace

(10) Patent No.: US 6,715,566 B2
(45) Date of Patent: Apr. 6, 2004

(54) BALANCE STRUCTURE FOR ROTATING MEMBER

(76) Inventor: Don Wallace, P.O. Box 76, Smithville, TX (US) 78957

( * ) Notice: Subject to any disclaimer, the term of this patent is extended or adjusted under 35 U.S.C. 154(b) by 63 days.

(21) Appl. No.: 10/135,003

(22) Filed: Apr. 29, 2002

(65) Prior Publication Data

US 2002/0117333 A1 Aug. 29, 2002

Related U.S. Application Data

(63) Continuation-in-part of application No. 09/606,607, filed on Jun. 29, 2000, now Pat. No. 6,378,626.

(51) Int. Cl.[7] ..... E21B 7/24
(52) U.S. Cl. ..... 175/56; 175/320
(58) Field of Search ..... 175/55–57, 101, 175/320, 325.5

(56) References Cited

U.S. PATENT DOCUMENTS

| | | | | |
|---|---|---|---|---|
| 4,059,165 A | | 11/1977 | Clark | |
| 4,270,619 A | | 6/1981 | Base | |
| 4,368,786 A | | 1/1983 | Cousins | |
| 4,385,669 A | | 5/1983 | Knutsen | |
| 4,456,080 A | | 6/1984 | Holbert | |
| 4,523,652 A | | 6/1985 | Schuh | |
| 4,577,701 A | | 3/1986 | Dellinger et al. | |
| 4,690,229 A | | 9/1987 | Raney | |
| 4,775,017 A | | 10/1988 | Forrest et al. | |
| 4,852,669 A | | 8/1989 | Walker | |
| 4,899,833 A | | 2/1990 | Warren et al. | |
| 4,905,776 A | * | 3/1990 | Beynet et al. | 175/56 |
| 5,033,558 A | | 7/1991 | Russo et al. | |
| 5,402,856 A | | 4/1995 | Warren et al. | |
| 5,458,208 A | | 10/1995 | Clarke | |
| 5,513,528 A | | 5/1996 | Holenka et al. | |

* cited by examiner

*Primary Examiner*—Zakiya Walker
(74) *Attorney, Agent, or Firm*—Law Office of Tim Cook P.C.

(57) ABSTRACT

A balancing structure to reduce vibration created in a rotating body by imbalance comprises an annular groove formed in the body, the groove partially filled with a quantity of solid balls. The solid balls, by only partially filling the groove, provide a stabilizing force that tends to compensate for the imbalance caused by different amounts of solids adhering to one side or the other of the body, such as for example a drilling assembly. The groove is preferably wider in a region further from the axis of rotation from the rotating body for more efficient balancing effect.

15 Claims, 5 Drawing Sheets

24
25
23
78
51
52
80
4
4
22a
82
60
61
63
62
63
5
5
65
64
22
3
3
20
26a
26c
26b
12
18

26
18
12
18
16
84
86
14
19
10

BALANCE STRUCTURE FOR ROTATING MEMBER

This application is a Continuation-in-Part of U.S. patent application Ser. No. 09/606,607 filed Jun. 29, 2000, now U.S. Pat. No. 6,378,626.

FIELD OF THE INVENTION

This invention relates generally to an improved method of and apparatus for drilling oil and gas wells and, more particularly, to a balance system for rotating equipment, such as a drill for drilling wells.

BACKGROUND OF THE INVENTION

When drilling with a mud motor, reactive torque is a problem. High drilling rates and high weight on the bit causes the mud motor to stall, the bit to stop, and the drill string to rotate in the opposite direction due to torque build-up in the drill string. Reactive and torsional loads on the drill string may also result in mud motor failure. The solution to this problem is taught and claimed in parent application Ser. No. 09/606,607, now U.S. Pat. No. 6,378,626.

Another common problem in the well drilling art is that of imbalance of the rotating member. An imbalance may occur when clay or other material adheres to the rotating member, thereby placing more weight on one side of the rotating member than the other. An imbalance may also occur during normal operations due to the slant of the well, and other reasons. The present invention is directed solving this problem of imbalance in the rotating member, and is particularly adapted to the imbalance that may occur in a drill string.

SUMMARY OF THE INVENTION

The apparatus of the invention shown and described in parent application Ser. No. 09/606,607, now U.S. Pat. No. 6,378,626 includes a drill bit, a fluid powered motor connected to the bit for rotating the bit, and an underreamer above the bit to increase the diameter of the well bore. That invention further includes a gear box positioned between the bit and the underreamer for transmitting the reactive torque of the fluid powered motor to the underreamer to rotate the underreamer in a direction opposite that of the bit. In that way, the torque rotating on the bit is substantially the same as the torque rotating the underreamer, thereby creating a balanced torque drilling system.

The present invention further includes structure to balance the rotating members. The embodiment described below relates generally to rotating members, and is applied in the specific example to a drill bit. Balancing the rotating members such as the bit, stabilizer and underreamer is accomplished by grooved circular races that contain a portion of high density small pellets in an oil/TEFLON fluid medium. The pellets do not fill the grooves so that centrifugal force produced by the rotating tool causes balancing and increases mud motor life by decreasing bearing failure.

These and other objects, advantages, and features of this invention will be apparent to those skilled in the art from this specification including the attached drawings, and appended claims.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

DETAILED DESCRIPTION OF A PREFERRED EMBODIMENT

Figure 1:
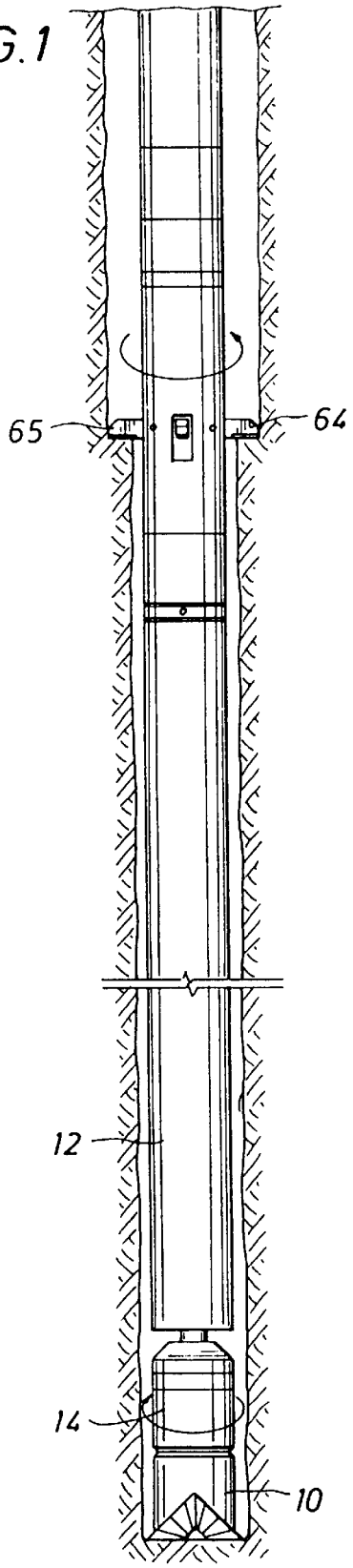
FIG. 1 is an elevation view of the drilling assembly of this invention in the process of drilling a well bore with a bit and underreamer spaced above the bit.

In FIG. 1, a drilling assembly is shown in elevation. At the lower end, a drill bit 10 is in contact with the bottom of a well bore 19 and is being rotated to the right relative to a housing 12 by the apparatus in housings 12 and 14 that will be described in detail below. The diameter of the well bore is further increased by an underreamer, shown as underreamer arms 64 and 65 in FIG. 1. The underreamer arms 64 and 65 are being rotated in a direction as shown in FIG. 1, i.e. in the direction opposite to that of the drill bit 10, to balance the torque in the drill string.

Figure 2A:
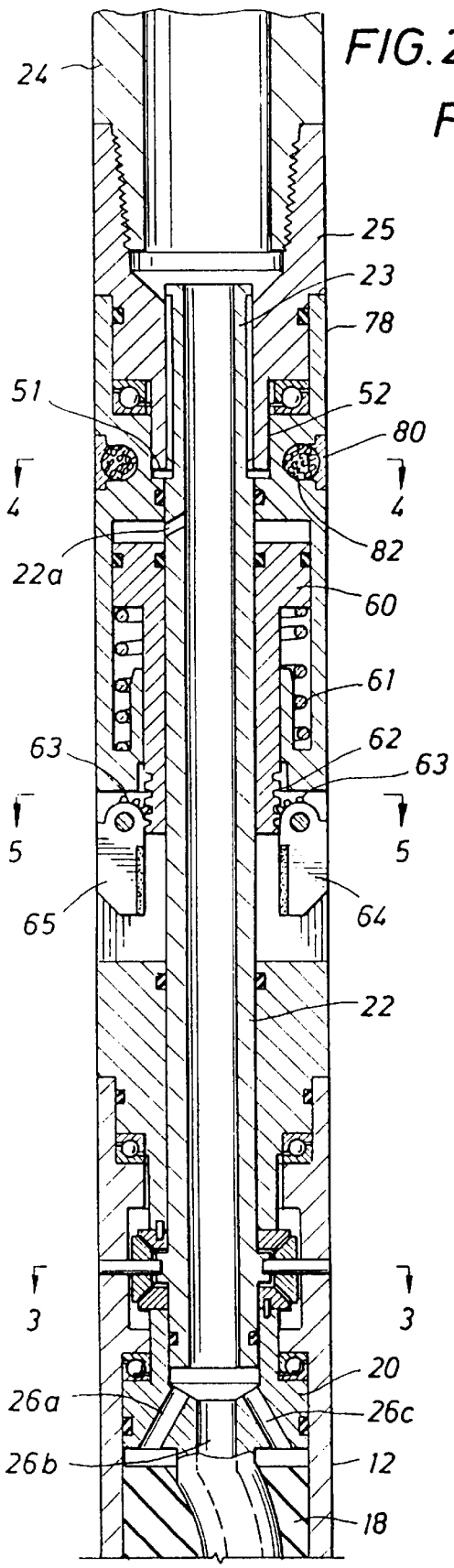
FIGS. 2A and 2B are sectional views of the portion of the drilling assembly of this invention from the drill bit to the drill pipe connected to the upper end of the drilling assembly.
Figure 2B:
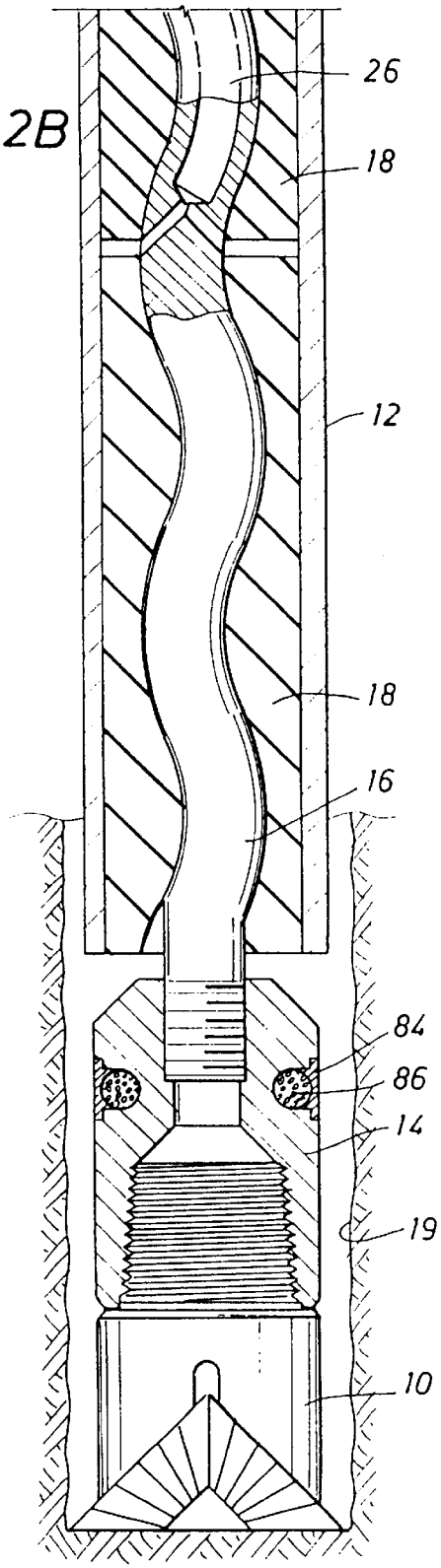

FIGS. 2A and 2B are sectional views of the apparatus for rotating the drill bit 10. The drill bit 10 that is in engagement with the bottom of the well bore is connected by a sub 14 to the end of an output shaft 16 of a pump 12, which is preferably a Robbins & Myers MOYNO®-brand pump, and referred to hereinafter as the "Moyno pump". In FIG. 2A, the upper end of the Moyno pump 12 is shown connected to a flow diverter 20. Above the flow diverter 20, a mandrel 22 extends from a tool joint box 25 to just above the flow diverter 20 and ties all the various parts of this tool together. The mandrel 22 is a hollow tube and the upper end of the mandrel is positioned in line with the opening in a drill pipe pin 24 as shown in FIG. 2A. Fluid pumped down the drill pipe will flow through the hollow central mandrel 22 and a set of ports 26*a*, 26*b*, and 26*c* in the flow diverter 20 positioned at the bottom of the tube-shaped mandrel.

The flow diverter 20 is an integral part of a shaft 16 of the Moyno pump 12. The center most port 26*b* is located in the impeller of the Moyno pump 12 and fluid flows through the port 26*b* to the top of a resilient body 18 of the Moyno pump 12. This fluid then provides the power to rotate the shaft 16 of the Moyno pump and the bit 10 that is attached to the lower end of output shaft 16 of the Moyno pump to drill the well bore 19.

The hollow mandrel 22 thereby functions as a torque tube and extends along the central axis of the apparatus from just above the resilient body 18 to just below the tool joint box 25. A spline connection 23 between the upper end of the torque tube and a bottom end 51 of the tool joint box 25 holds the torque tube from rotating around the central axis of the tool. The lower end of the torque tube is prevented from rotating by a set of pins 36*a* and 36*c* that extend through pinions 28*a* and 28*c*, respectively, and the wall of the housing 12. The torque tube, preferably made of titanium, a composite or other appropriate material, serves to absorb shock torque especially from formation breaks, but also to permit rotating the drill string with the rotary table while drilling with a mud motor. This allows the tool to build angle with stabilizers when desired.

Figure 3:
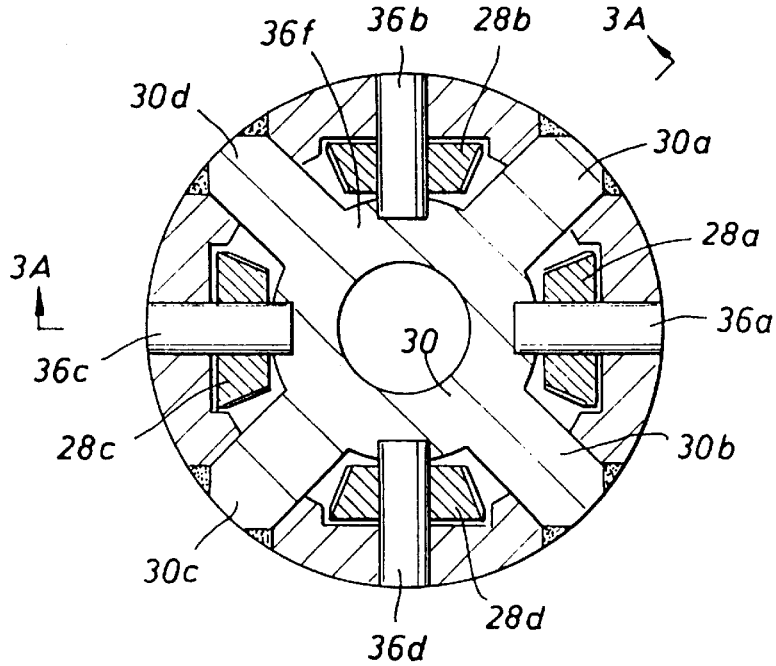
FIG. 3 is a top sectional view of the gear box, taken along the section lines 3—3 of FIG. 2A.
Figure 3A:
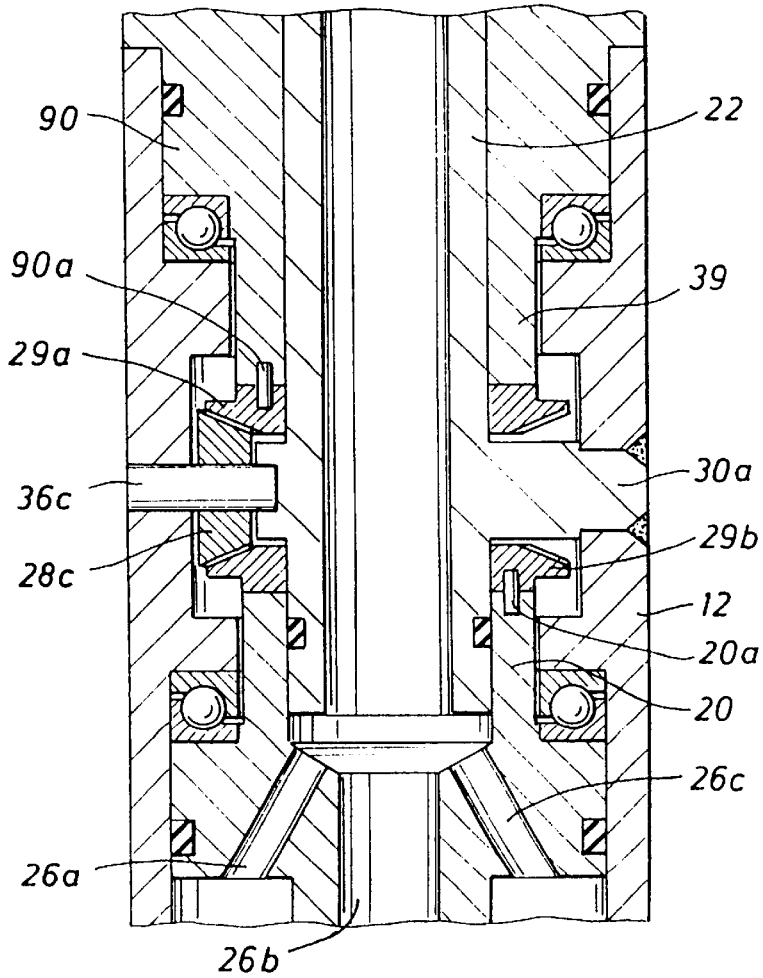
FIG. 3A is a detail elevation section view of the gear box portion of the drilling assembly taken along line 3A—3A of FIG. 3.
Figure 6:
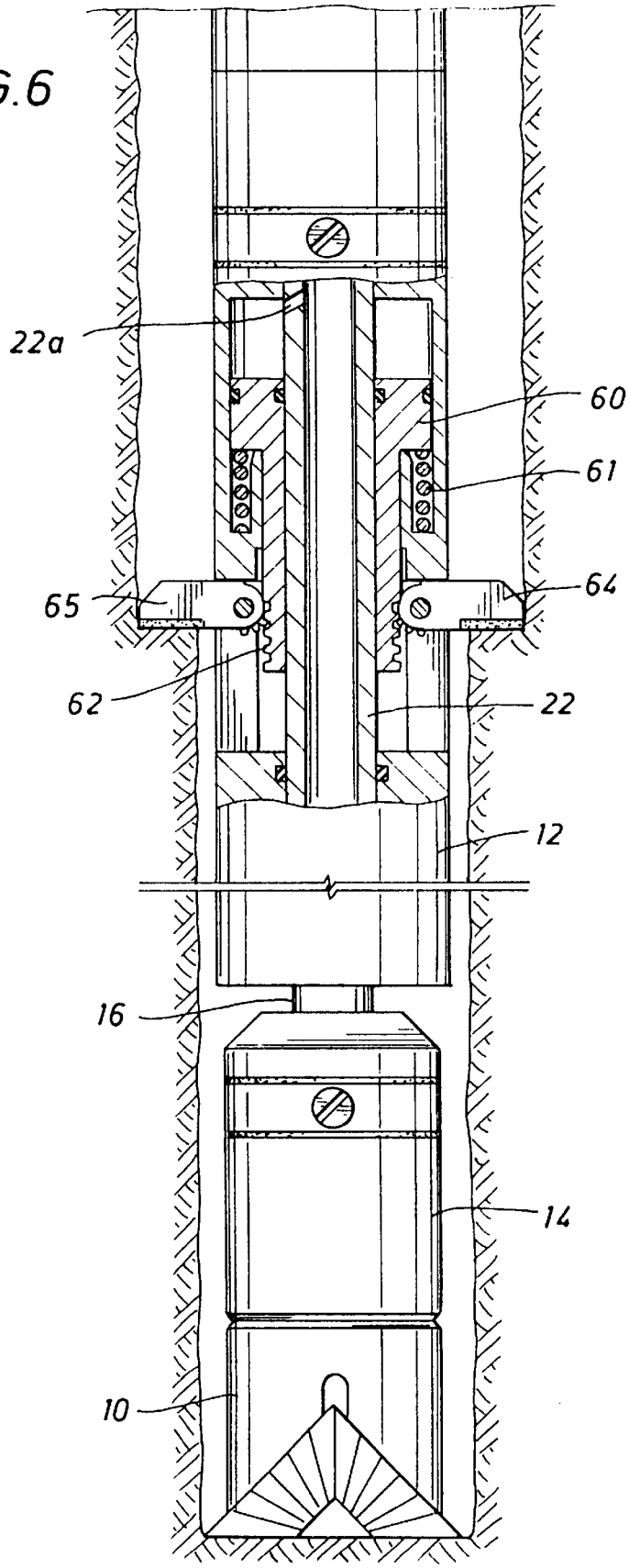
FIG. 6 is an elevation section view depicting the components of the underreamer as the well bore is being drilled.

FIGS. 3 and 3A are enlarged sectional views of the gear box that is located above the Moyno pump and connected to the mandrel 22. As shown in FIG. 3, there are four equally spaced pinions, i.e. 28*a*, 28*b*, 28*c*, and 28*d* in the gear train which engage two longitudinally spaced, annular bevel ring gears 29*a* and 29*b*, the beveled ring gear teeth of which diverge outwardly. The upper ring gear 29*a* is pinned to an upper spacer 90 with a pin 90*a* and the lower ring gear 29*b* is pinned to a lower spacer 20. The pins connecting the upper and lower ring gears to the spacers hold the ring gears from rotation relative to the spacers and the housing. The pinion 28*a* is not shown in FIG. 3A in order to show the structural arrangement of arms 30*a*–30*d* of an anchor spider 30 on which the pinions are mounted. The spider consists of a central tubular section 36*f* with four arms 30*a*, 30*b*, 30*c*, and 30*d* symmetrically extending radially from the center section. The central section is designated by number 30*f* and the arms are 30*a* through 30*d*. The arms are welded to tubular housing 39 in which they are located, as shown in FIGS. 3 and 3A. The pins 36*a* through 36*d* are mounted in the wall of the housing and support the pinions 28*a* through 28*d* for rotation as shown in FIG. 3.

FIG. 3A is the vertical section through FIG. 3 taken along section line 3A—3A. Consequently, the pinion on pin 36*a* is not shown. As explained above, drilling fluid is pumped down through the center of mandrel 22 and when the fluid reaches the lower end of the mandrel the fluid exits through the large center port 26*b* and provides drilling fluid under pressure to the Moyno pump 12 to rotate bit 10 that is connected to the lower end of the apparatus. Portions of the fluid in mandrel 22 is diverted through the smaller outlets 26*a* and 26*c*. This fluid flows through the opening 26*b* into the Moyno pump to provide the force necessary to rotate motor shaft 16 of the Moyno pump and the bit 10.

The torque tube or mandrel 22 has an opening 22*a* as shown in FIG. 2A through which drilling fluid being pumped down the drill pipe into the motor will flow and exert a downward force on a piston 60, causing the piston to move downwardly against a spring 61 so that rachet teeth 62 that engage rachet teeth 63 on underreamer cutting arms 64 and 65, will rotate the cutting arms outwardly to a lateral position relative to the longitudinal axis of the tool rotation. Extension of the underreamer cutting arms 64 and 65 causes them to enlarge the diameter of the hole being drilled by bit 10 as the underreamer is rotated and lowered as shown in FIG. 1.

To this point, the focus on the detailed description has been on the structure which reduces the torque in the drilling apparatus, one of the factors in premature failure of the tool. Another significant factor in premature mud motor failures is caused by imbalance and harmonic vibrations, caused when the bit, the stabilizers, and the underreamers get unbalanced due to cuttings getting packed into stabilizer ribs (leading edges) and drilling bit legs. This extra weight is eccentric to the center line of the drilling assembly and that creates an imbalance and vibrations that creates a side thrust load on the mud motor bearings.

This imbalance is compensated for in the present invention by a balancing ring. The balancing ring comprises annular, ring-shaped groove 82, preferably with a semicircular bottom. The groove 82 is filled with balls of high density metal, such as lead, tungsten carbide, or depleted uranium, or other desired material. Preferably, the balls do not completely fill the groove so they can move to a position in the groove in response to the centrifugal force on the balls produced by the rotation of the tool and to provide a balancing force to the rotating members. The balls are sealed in place with a cap 80. A balancing ring 86 may also be included in the body 14, as shown in FIG. 2B, with balls sealed in place with a cap 84.

Figure 4:
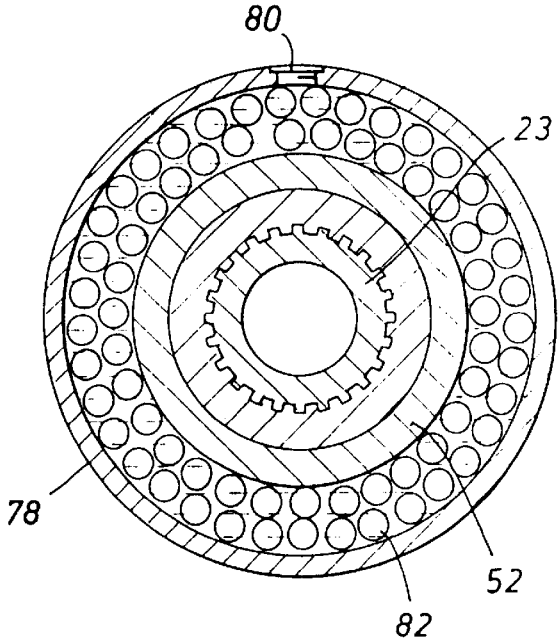
FIG. 4 is a top sectional view taken along line 4—4 of FIG. 2A of the balancing ring of the present invention.
Figure 5:
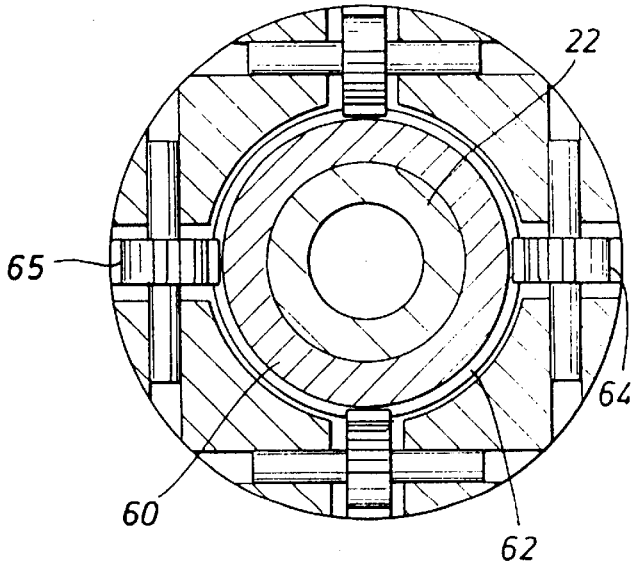
FIG. 5 is a top sectional view taken along line 5—5 of FIG. 2A.

Such circumferential balancing rings, such as those illustrated at 82 and 86, on rotating members are preferably filled with a high density medium, such as tungsten or depleted uranium in a low viscosity fluid, such as light oil and a TEFLON liquid carrier. The balls, heavier than the liquid carrier, tend to self balance by rotating centrifugal force. The high density medium compensates for the imbalance caused by the extra mass of impacted/compacted formation. These rings may be machined on rotating members, such as for example stabilizers, underreamers, bit subs, and the like, and filled with the high-density balancing fluid. FIG. 4 is a cross sectional view taken along line 4—4 of FIG. 2A of the balancing ring 82. The mandrel 22 is in the center surrounded by a portion of the ring 82 and the upper end of torque tube 22 and spline connection 23.

Figure 7:
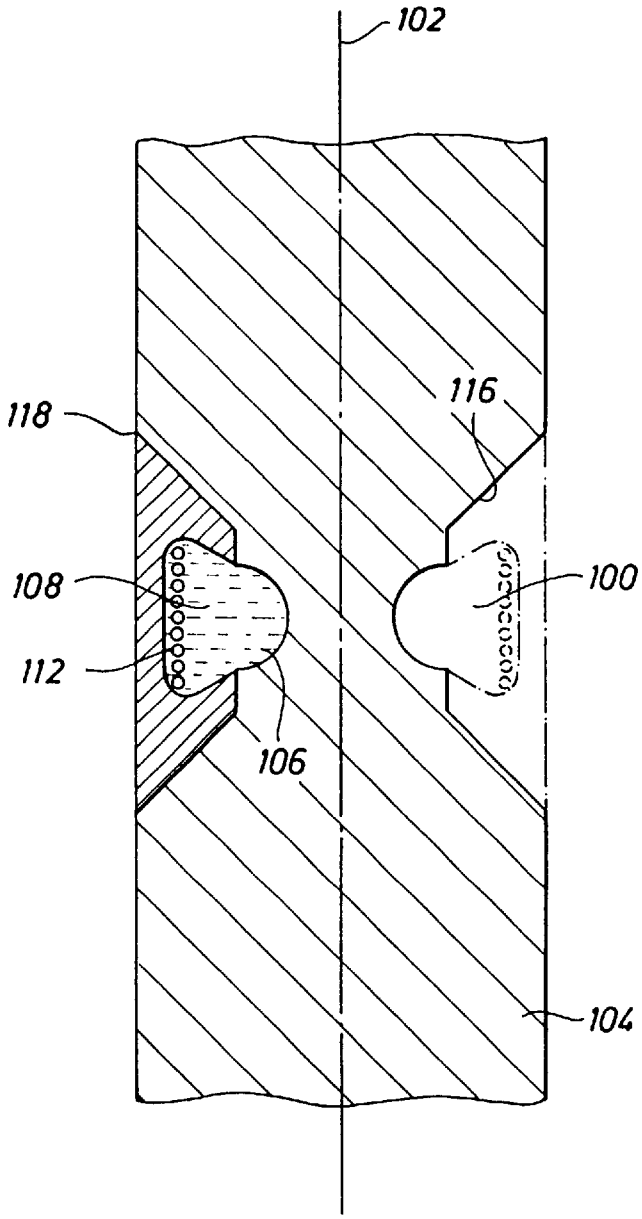
FIG. 7 is an elevation section view of a rotating member with a preferred balance member and insert.
Figure 7A:
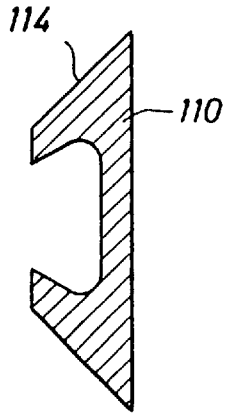
FIG. 7*a* is a detail section view of such an insert.

While FIGS. 2A and 2B depict the balancing rings 82 and 86 as circular in cross section, an advantage may be obtained where the balancing ring is non-circular in cross section. Such a balancing ring 100 is shown in FIG. 7. The distinctive feature of the balancing ring 100 is that it widens with outward radial distance from a centerline axis 102 of a rotating member 104. The balancing ring defines an inner volume 106, which may define a circular cross section, and an outer volume 108, which expands the further from the centerline the ring goes. The balancing ring is further defined by the inner volume formed in the rotating member, and the out volume is formed in an annular insert 110. FIG. 7A depicts a cross section of the insert.

The balancing ring is partially filled with heavy beads 112, as before. The remaining portion of the balancing ring may be filled with air, but is preferably filled with a fluid. The advantage of the non-circular shape of the balancing ring is shown in FIG. 7, in that the greatest amount of mass of the beads 112 is moved to the furthest point from the axis 102 when the ring widens out. The beads then tend to form the shallowest layer of beads, furthest from the axis 102, thereby providing the greatest balancing effect in the least volume of ring and least quantity of beads. Note also that the insert preferably defines a slanted surface 114 which mates with a slanted surface 116 formed in the rotating member 104. This feature provide ease of manufacture, and also provides an easily accessible seam 118 for welding the insert onto the rotating member.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A balance structure for a rotating member comprising:

a. a tool body defining an annular, ring-shaped groove;

b. a quantity of solid balls partially filling the groove; and c. an insert adapted to retain the balls within the groove, wherein the insert defines a slanted surface for abutting engagement with a complementary surface on the tool body.

2. The balance structure of claim 1, further comprising a low viscosity fluid in the groove.

3. The balance structure of claim 1, wherein the solid balls are made of a material selected from the group consisting of lead, tungsten carbide, and depleted uranium.

4. The balance structure of claim 1, wherein the groove is non-circular in cross section.

5. The balance structure of claim 1, wherein the rotating member defines an axis of rotation, and further wherein the groove widens with radial distance from the axis of rotation.

6. A downhole drilling assembly including a drill bit on a drill string, the drill bit defining a body having an annular groove formed therein, the groove partially filled with a quantity of solid balls to provide a stabilizing force that tend to compensate for the imbalance caused by different amounts of solids adhering to one side or the other of the drilling assembly, the drill bit further comprising an insert adapted to retain the balls within the groove, wherein the insert defines a slanted surface for abutting engagement with a complementary surface on the body.

7. The assembly of claim 6, further comprising a low viscosity fluid in the groove.

8. The assembly of claim 6, wherein the solid balls are made of a material selected from the group consisting of lead, tungsten carbide, and depleted uranium.

9. The assembly of claim 6, wherein the groove is non-circular in cross section.

10. The assembly of claim 6, wherein the body defines an axis of rotation, and further wherein the groove widens with radial distance from the axis of rotation.

11. A method of reducing vibrations created by imbalance in a rotating member, comprising the steps of:

a. forming an annular groove in the rotating member;

b. partially filling the annular groove with a quantity of solid balls; and c. retaining the balls within the groove with an insert, wherein the insert defines a slanted surface for abutting engagement with a complementary surface on the rotating member.

12. A The method of claim 11, further comprising the step of adding a low viscosity fluid to the groove.

13. The method of claim 11, wherein the rotating member comprises a drill bit.

14. The method of claim 11, wherein the groove is non-circular in cross section.

15. The method of claim 11, wherein the rotating member defines an axis of rotation, and further wherein the groove widens with radial distance from the axis of rotation.

* * * * *